US008827009B1

(12) United States Patent
Rankin, III

(10) Patent No.: US 8,827,009 B1
(45) Date of Patent: Sep. 9, 2014

(54) DRILLING PRESSURE INTENSIFYING DEVICE

(76) Inventor: Robert E. Rankin, III, Wayne, OK (US)

( * ) Notice: Subject to any disclaimer, the term of this patent is extended or adjusted under 35 U.S.C. 154(b) by 650 days.

(21) Appl. No.: 13/068,300

(22) Filed: May 6, 2011

Related U.S. Application Data

(60) Provisional application No. 61/395,241, filed on May 10, 2010.

(51) Int. Cl.
*E21B 4/00* (2006.01)

(52) U.S. Cl.
USPC ..... 175/107; 175/93

(58) Field of Classification Search
CPC ..... E21B 7/18; E21B 4/02; E21B 7/08
USPC ..... 175/67, 93, 102, 107, 215
See application file for complete search history.

(56) References Cited

U.S. PATENT DOCUMENTS

| | | | | |
|---|---|---|---|---|
| 3,133,603 | A * | 5/1964 | Pierre et al. | 175/107 |
| 5,787,998 | A * | 8/1998 | O'Hanlon et al. | 175/67 |
| 6,056,054 | A * | 5/2000 | Brady et al. | 166/265 |
| 6,073,708 | A * | 6/2000 | Brown et al. | 175/93 |
| 6,289,998 | B1 * | 9/2001 | Krueger et al. | 175/25 |
| 7,810,583 | B2 * | 10/2010 | Ruggier et al. | 175/57 |
| 2006/0113114 | A1 * | 6/2006 | Jin et al. | 175/67 |
| 2010/0116554 | A1 * | 5/2010 | Yatsenko | 175/107 |
| 2010/0307833 | A1 * | 12/2010 | Koll et al. | 175/107 |

* cited by examiner

*Primary Examiner* — Kenneth L Thompson
*Assistant Examiner* — Michael Wills, III
(74) *Attorney, Agent, or Firm* — R. Keith Harrison

(57) ABSTRACT

A drilling pressure intensifying device includes a device housing, a device shaft mounted for rotation in the device housing, at least one fluid conduit in the device shaft and a fluid pressure intensifying assembly in the fluid conduit.

20 Claims, 7 Drawing Sheets

DRILLING PRESSURE INTENSIFYING DEVICE

CROSS-REFERENCE TO RELATED APPLICATIONS

This application claims the benefit of U.S. provisional application No. 61/395,241, filed May 10, 2010 and entitled "DRILLING PRESSURE INTENSIFYING DEVICE", which provisional application is incorporated by reference herein in its entirety.

FIELD

The disclosure generally relates to drill strings for drilling subterranean wells. More particularly, the disclosure relates to a drilling pressure intensifying device which amplifies the pressure of drilling fluid used to augment the drilling efficacy or speed of a drill bit in the drilling of subterranean wells.

BACKGROUND

In the production of fluid hydrocarbons, well bores are typically formed in a subterranean hydrocarbon formation by rotating a drill bit attached to a drill string through the ground and into the underlying formation. The conventional manner of drilling a well bore typically involves rotating the drill bit at the end of the drill string by operation of a mud motor. The mud motor is typically a positive displacement motor in which pressurized drilling fluid flows into a cavity formed between a rotor and a stator. The drilling fluid drives the rotor which, in turn, rotates the drill bit coupled to the motor.

Under circumstances in which drilling is carried out in a hard or compact drilling medium such as rock, a jet of pressurized drilling fluid may complement the cutting action of the drill bit to increase the speed of the drilling operation. In some applications, the same drilling fluid which is used to drive the rotor and the drill bit of the mud motor may be distributed through conduits and ejected from discharge openings in the drill bit against the medium. In such applications, however, the pressure of the drilling fluid may not be sufficient to significantly enhance the cutting action of the drill bit, particularly under circumstances in which the drilling medium is highly resistant to the drilling operation.

Therefore, a drilling pressure intensifying device which amplifies the pressure of drilling fluid used to augment the drilling efficacy or speed of a drill bit in the drilling of subterranean wells is needed.

SUMMARY

The disclosure is generally directed to a drilling pressure intensifying device which amplifies the pressure of drilling fluid used to augment the drilling efficacy or speed of a drill bit in the drilling of subterranean wells. An illustrative embodiment of the drilling pressure intensifying device includes a device housing, a device shaft mounted for rotation in the device housing, at least one low pressure fluid conduit in the device shaft, at least one high pressure fluid conduit in the device shaft and disposed in fluid communication with the at least one low pressure fluid conduit and a fluid pressure intensifying assembly in the at least one high pressure fluid conduit and drivingly engaged for rotation by the device shaft.

In some embodiments, the drilling pressure intensifying device may include a device housing; a device shaft mounted for rotation in the device housing; a drill bit terminating the device shaft; at least one low pressure fluid conduit in the device shaft and opening through the drill bit; at least one high pressure fluid conduit in the device shaft and disposed in fluid communication with the at least one low pressure fluid conduit; and a fluid pressure intensifying assembly in the at least one high pressure fluid conduit. The fluid pressure intensifying assembly includes a stator drivingly engaged for rotation by the device shaft and having a stator interior opening through the drill bit, spiral stator threads and spiral stator grooves in the stator interior and at least one stator lobe in the stator interior and a rotor having a rotor shaft base rotatable in the stator interior of the stator, spiral rotor threads and spiral rotor grooves on the rotor shaft base and partially meshing with the stator grooves and the stator threads, respectively, of the stator and at least one rotor lobe shaped in the rotor shaft base and engaged by the at least one stator lobe.

In some embodiments, the drilling pressure intensifying device may include a device housing; a device shaft mounted for rotation in the device housing and having a fluid inlet end and a fluid outlet end opposite the fluid inlet end; a drill bit terminating the device shaft at the fluid outlet end; a low pressure fluid conduit centrally disposed in the device shaft and extending generally from the fluid inlet end to the fluid outlet end; a plurality of low pressure fluid outlet passages communicating with the low pressure fluid conduit and opening through the drill bit; a plurality of high pressure fluid conduits eccentrically located with respect to a central rotational axis of the device shaft and spaced around the low pressure fluid conduit; a plurality of fluid diversion passages establishing fluid communication between the low pressure fluid conduit and the plurality of high pressure fluid conduits, respectively; a ring gear having ring gear teeth between the device shaft and the device housing; and a fluid pressure intensifying assembly in each of the high pressure fluid conduits. The fluid pressure intensifying assembly includes a stator mounted for rotation in the high pressure fluid conduit and having a stator interior, spiral stator threads and spiral stator grooves in the stator and facing the stator interior, at least one stator lobe on the stator in the stator interior and stator teeth provided on the stator and meshing with the ring gear teeth of the ring gear; and a rotor rotatable in the stator interior of the stator, spiral rotor threads and spiral rotor grooves on the rotor and partially meshing with the stator grooves and the stator threads, respectively, of the stator and at least one rotor lobe shaped in the rotor and engaged by the at least one stator lobe of the stator; and a plurality of high pressure fluid outlet passages communicating with the stator interior of the stator and opening and discharging through the drill bit.

In some embodiments, the drilling pressure intensifying device includes a device housing; a device shaft mounted for rotation in the device housing; at least one fluid conduit in the device shaft; and a fluid pressure intensifying assembly in the at least one fluid conduit and including a stator drivingly engaged for rotation by the device shaft and having a stator interior, spiral stator threads and spiral stator grooves in the stator interior and at least one stator lobe; and a rotor drivingly engaged for rotation by the stator in the stator interior and having spiral rotor threads and spiral rotor grooves partially meshing with the stator grooves and the stator threads, respectively, of the stator and at least one rotor lobe engaged by the at least one stator lobe of the stator.

BRIEF DESCRIPTION OF THE DRAWINGS

The disclosure will now be made, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the claims. Furthermore, there is no intention to be bound by any expressed or implied theory presented in the preceding technical field, background, brief summary or the following detailed description.

Figure 5:
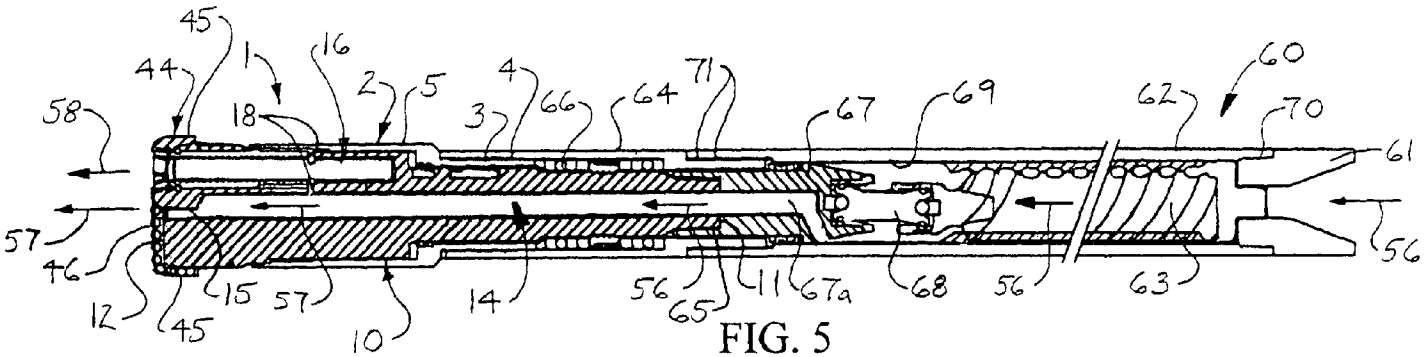
FIG. 5 is a longitudinal sectional view of an illustrative embodiment of the drilling pressure intensifying device, coupled to a drill string.
Figure 6:
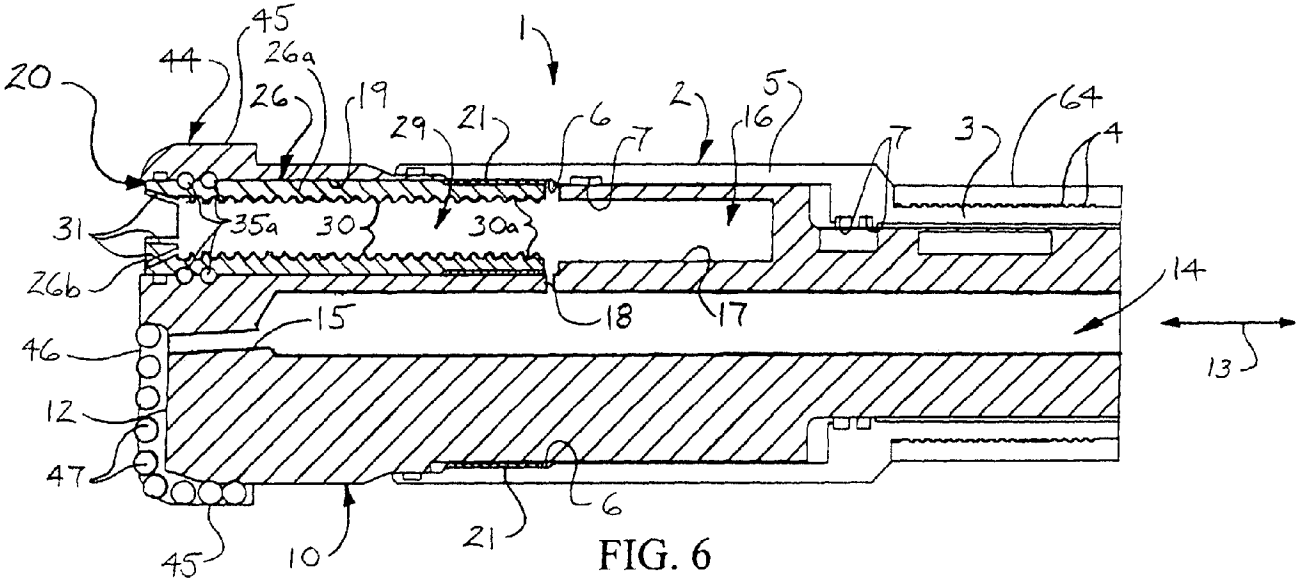
FIG. 6 is an enlarged longitudinal sectional view of the drilling pressure intensifying device illustrated in FIG. 5, with a rotor omitted from a stator of a fluid pressure intensifying assembly in the device for illustrative purposes.
Figure 7:
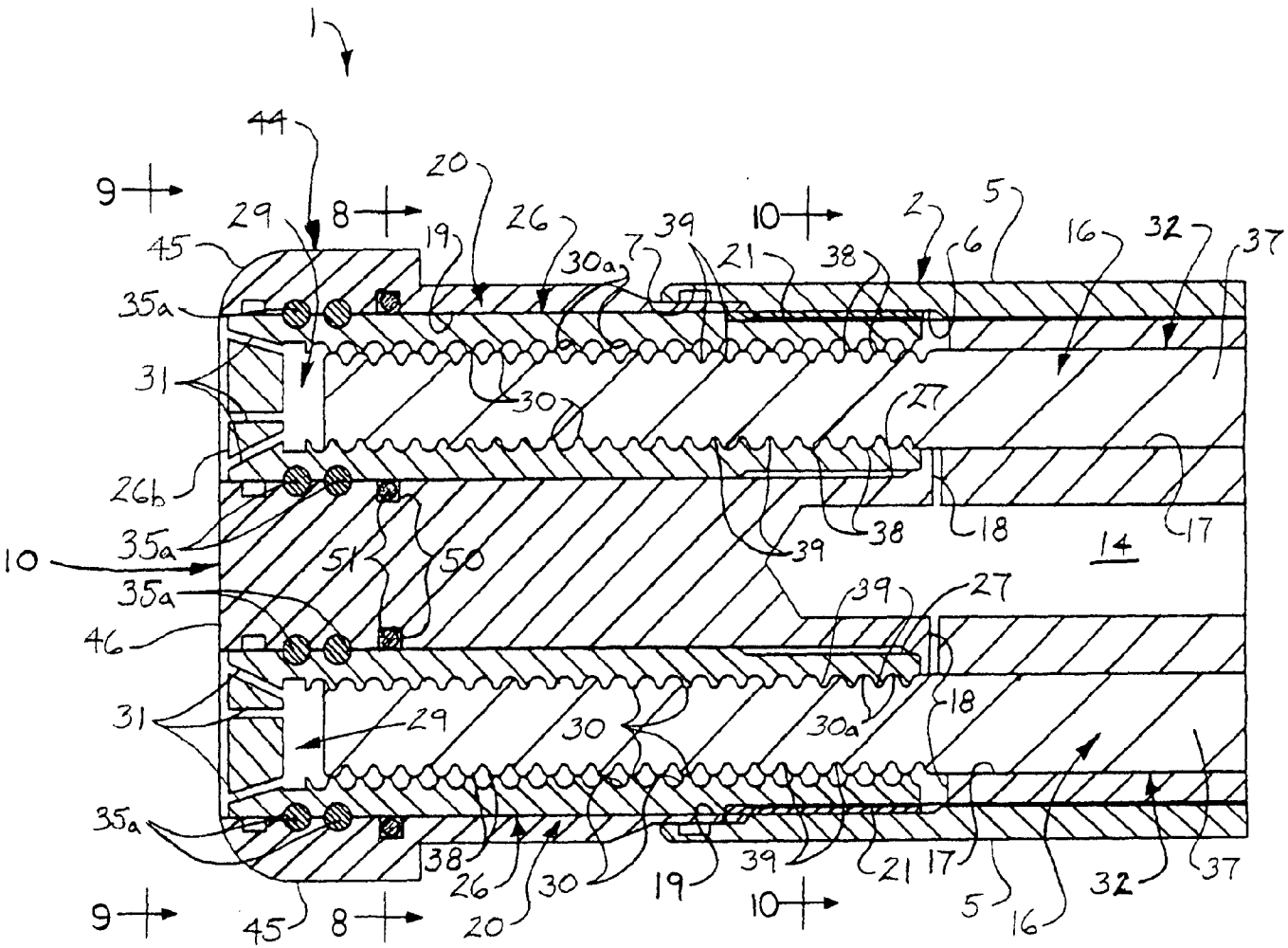
FIG. 7 is a longitudinal sectional view of an illustrative embodiment of the drilling pressure intensifying device, with the rotor inserted in the stator of each of a pair of pressure intensifying assemblies in the device.

Referring initially to FIGS. 5-7 of the drawings, an illustrative embodiment of the drilling pressure intensifying device, hereinafter device, is generally indicated by reference numeral 1. As will be hereinafter described, the device 1 is a pump which may be drivingly engaged for rotation by a drill string 60 (FIG. 5) which is coupled to a drive mechanism (not illustrated) such as a positive displacement motor, for example and without limitation. The positive displacement motor may be a conventional "mud motor" which is extensively used in drilling applications in the oil and gas industry. The device 1 may be fitted with a drill bit 44 which may have a conventional design with drill bit sides 45, a drill bit face 46 and cutting elements 47 on the drill bit sides 45 and the drill bit face 46. Outer cutting teeth 48 (FIGS. 8 and 9) may extend from the drill bit sides 45 of the drill bit 44.

As illustrated in FIG. 5 and will be hereinafter described, the device 1 is adapted to receive a stream of pressurized drilling fluid 56 as the drilling fluid 56 actuates rotation of the device 1 and the drill bit 44 through the drill string 60. In a manner which will be hereinafter described, the device 1 is adapted to augment or intensify the pressure of at least a portion of the drilling fluid 56 and eject at least one high pressure stream 58 of the pressurized drilling fluid 56 from the drill bit face 46 of the drill bit 44. The device 1 may further be adapted to eject at least one low pressure stream 57 of the pressurized drilling fluid 56 from the drill bit face 46 of the drill bit 44. Therefore, the ejected high pressure stream or streams 58 alone or in combination with the low pressure stream or streams 57 of the drilling fluid 56 may complement and enhance the cutting action of the drill bit 44 as the drill bit 44 is operated to drill a well bore (not illustrated) through a subterranean hydrocarbon formation (not illustrated) or other medium.

Referring next to FIGS. 1-11 of the drawings, the device 1 may include a device housing 2 and a device shaft 10 which is rotatable inside the device housing 2. The device shaft 10 may be adapted to be rotated inside the device housing 2 by operation of a positive displacement motor or "mud motor" (not illustrated) which is coupled to the drill string 60 (FIG. 5) as will be hereinafter described. The device housing 2 may include a housing collar 3 which may be fitted with exterior housing collar threads 4. A generally elongated, cylindrical housing wall 5 which is larger in diameter than the housing collar 3 may extend from the housing collar 3. As illustrated in FIG. 6, the device shaft 10 may have a profile in longitudinal sectional view which generally corresponds to the configuration of the device housing 2 with the narrow diameter of the housing collar 3 relative to the larger diameter of the housing wall 5. A ring gear groove 6 may be provided in the interior surface of the housing wall 5 for purposes which will be hereinafter described. Seal grooves 7 may be provided in the interior surface of the housing wall 5 to receive seal rings (not illustrated) which form a fluid-tight seal between the device shaft 10 and the device housing 2.

Figure 9:
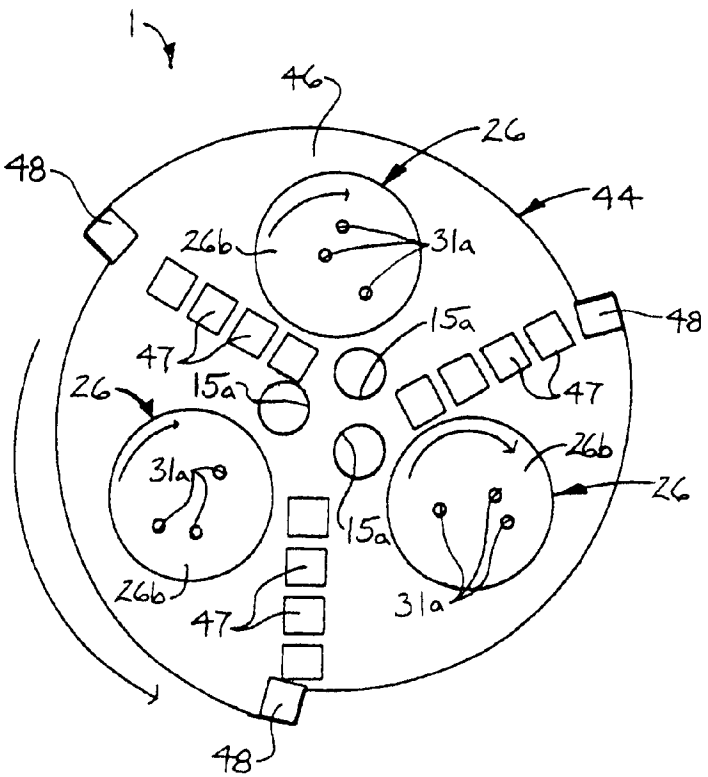
FIG. 9 is an end view, taken along viewing lines 9-9 in FIG. 7, of an illustrative embodiment of the drilling pressure intensifying device.

As illustrated in FIG. 5, the device shaft 10 may have a fluid inlet end 11 and a fluid outlet end 12 which is opposite the fluid inlet end 11. The fluid outlet end 12 of the device shaft 10 may be disposed adjacent to or in engagement with the inner surface of the drill bit face 46 of the drill bit 44. At least one low pressure fluid conduit 14 may extend through the device shaft 10 from the fluid inlet end 11 and terminate near the fluid outlet end 12, as illustrated in FIGS. 5 and 6. The low pressure fluid conduit 14 may be centrally disposed in the device shaft 10, coinciding with a central rotational axis 13 (FIG. 6) of the device shaft 10. At least one low pressure fluid outlet passage 15 may be disposed in fluid communication with the low pressure fluid conduit 14 and discharge at the fluid outlet end 12 of the device shaft 10. As illustrated in FIG. 9, at least one low pressure discharge opening **15*a* may open to the outer surface of the drill bit face 46 on the drill bit 44 and communicate with each low pressure fluid outlet passage 15 (FIG. 6**).

Figure 8:
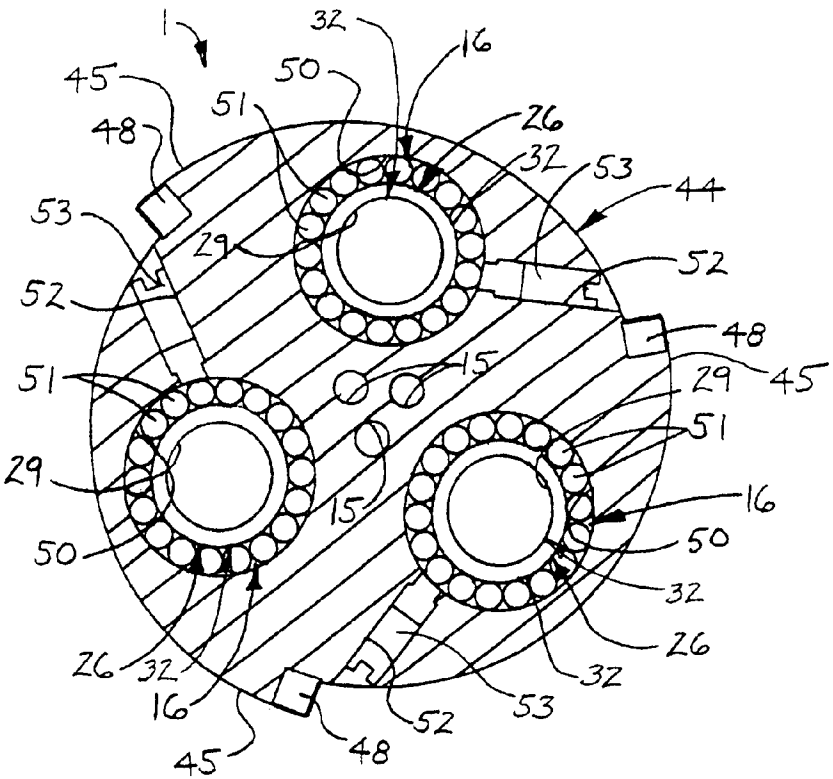
FIG. 8 is a cross-sectional view, taken along section lines 8-8 in FIG. 7, of an illustrative embodiment of the drilling pressure intensifying device.

As further illustrated in FIGS. 5 and 6, at least one high pressure fluid conduit 16 may be provided in the device shaft 10. As illustrated in FIG. 6, each high pressure fluid conduit 16 may have a longitudinal axis which may be oriented in generally parallel relationship with respect to a longitudinal axis of the low pressure fluid conduit 14. Each high pressure fluid conduit 16 may be positioned between the low pressure fluid conduit 14 and the outer surface of the device shaft 10. Each high pressure fluid conduit 16 may be eccentrically located with respect to the central rotational axis 13 (FIG. 6) of the device shaft 10. As illustrated in FIG. 8, in some embodiments multiple high pressure fluid conduits 16 may be eccentrically arranged with respect to the central rotational axis 13 (FIG. 6) of the device shaft 10 around the low pressure fluid conduit 14.

As illustrated in FIG. 6, each high pressure fluid conduit 16 may include a rotor cavity 17 and a stator cavity 19 which extends from and communicates with the rotor cavity 17 and opens to the fluid outlet end 12 of the device shaft 10. Each high pressure fluid conduit 16 may be disposed in fluid communication with the low pressure fluid conduit 14 through at least one fluid diversion passage 18. The fluid diversion passage 18 may communicate with the high pressure fluid conduit 16 at a point which is generally between the rotor cavity 17 and the stator cavity 19 thereof.

Figures 2, 3:
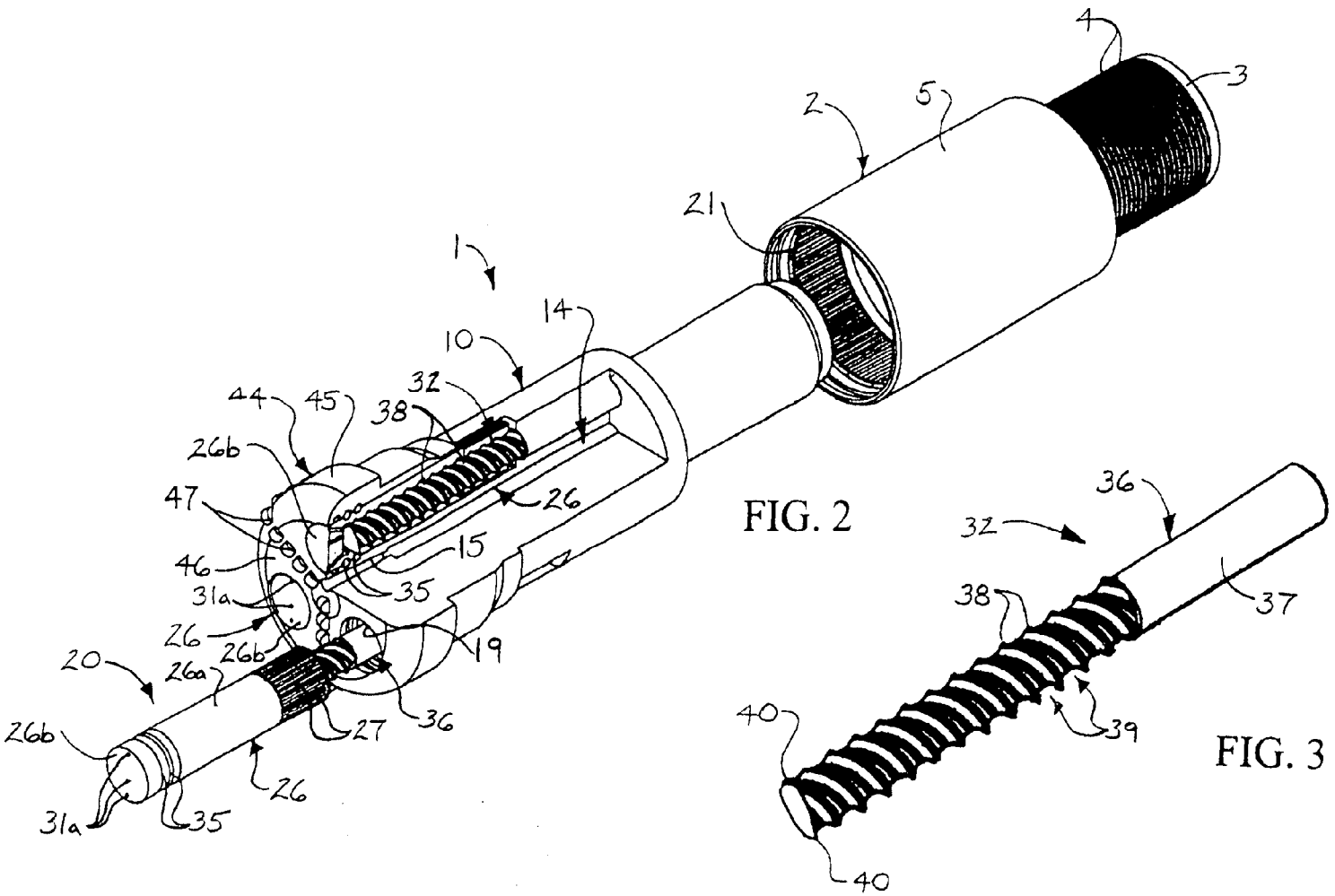
FIG. 2 is an exploded perspective view, partially in section, of an illustrative embodiment of the drilling pressure intensifying device, with the device shaft removed from the device housing of the device.
FIG. 3 is a perspective view of a rotor shaft which is suitable for implementation of an illustrative embodiment of the drilling pressure intensifying device.
Figure 4:
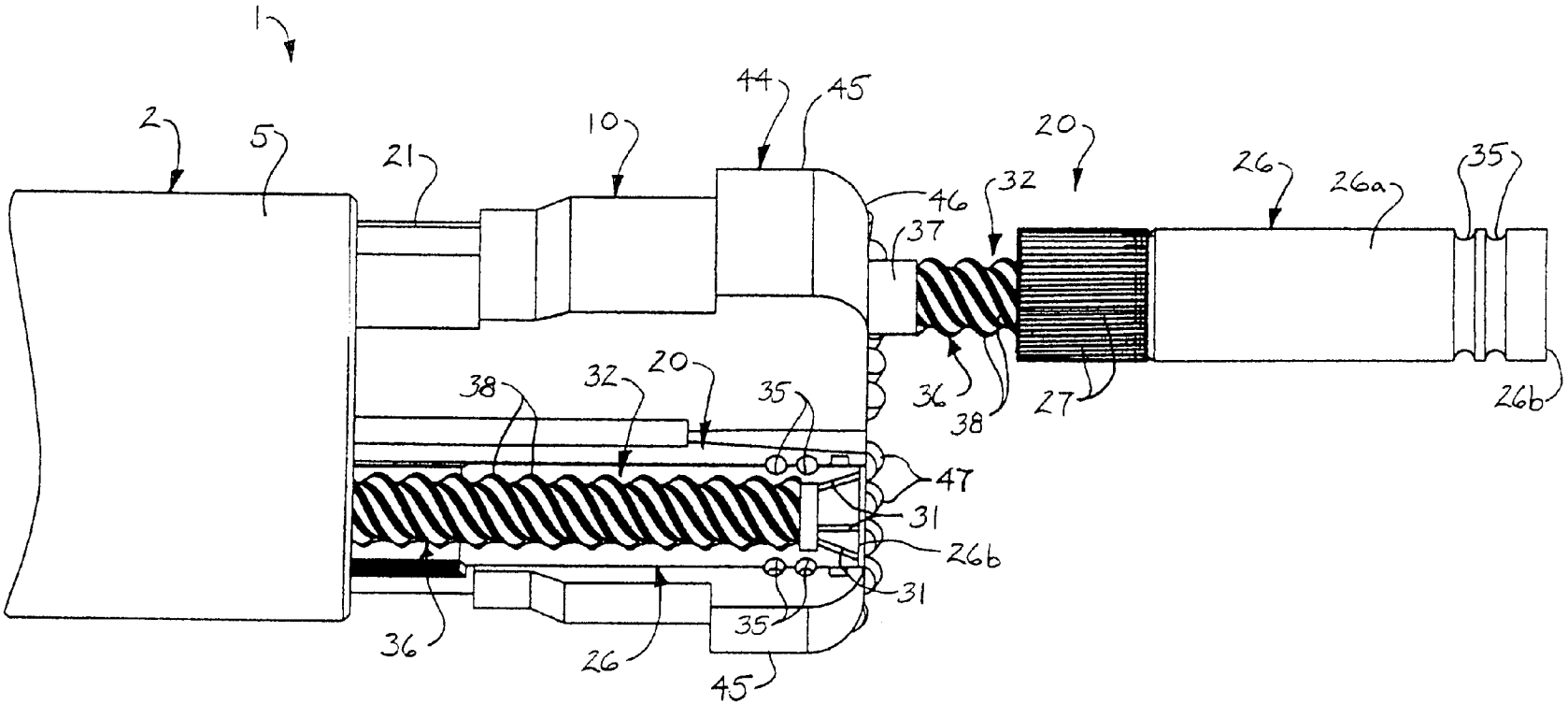
FIG. 4 is an exploded side view, partially in section, of an illustrative embodiment of the drilling pressure intensifying device, with one of multiple fluid pressure intensifying assemblies partially removed from the device shaft and another fluid pressure intensifying assembly inserted in the device shaft.
Figure 10:
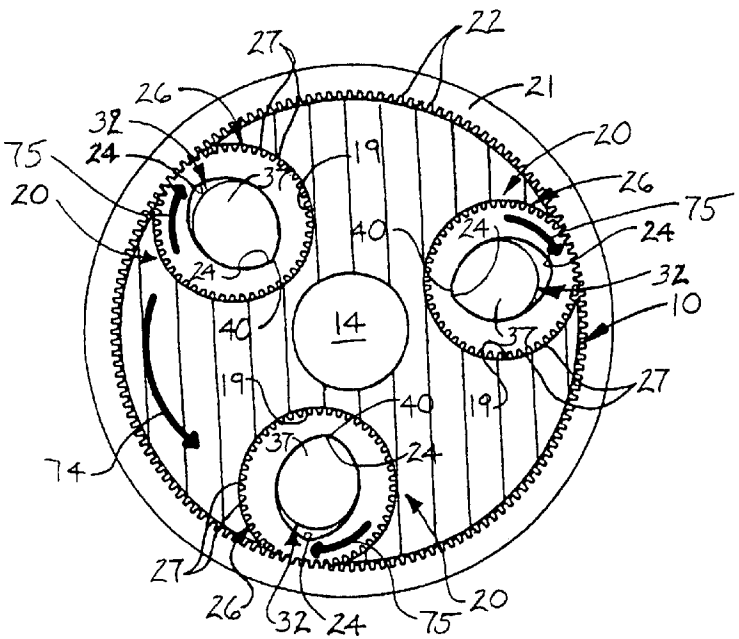
FIG. 10 is a cross-sectional view, taken along section lines 10-10 in FIG. 7, of an illustrative embodiment of the drilling pressure intensifying device.

As illustrated in FIG. 7, a fluid pressure intensifying assembly 20 may be provided in each high pressure fluid conduit 16. The fluid pressure intensifying assembly 20 may include a ring gear 21 having ring gear teeth 22 (FIG. 10) and which is provided around the interior circumferential surface of the device housing 2. As illustrated in FIG. 10, the inner curvature of the ring gear 21 may generally coincide with the outer curvature of the stator cavity 19 of each high pressure fluid conduit 16. Therefore, as further illustrated in FIG. 10, the ring gear teeth 22 of the ring gear 21 may extend into the outer portion of the stator cavity 19 of each high pressure fluid conduit 16. As illustrated in FIG. 2, the ring gear 21 may be seated in the ring gear groove 6 (FIG. 7) on the interior surface of the housing wall 5 of the device housing 2.

As further illustrated in FIGS. 1-4 and 7, a stator 26 may be provided in the stator cavity 19 of each high pressure fluid conduit 16. As illustrated in FIG. 2, the stator 26 of each fluid pressure intensifying assembly 20 may include a generally elongated, cylindrical stator body 26*a* having a fluid discharge end 26*b*. At least one circumferential seal ring groove 35 (FIG. 2) may be provided in the stator body 26*a*. At least one seal ring 35*a* (FIG. 6) may be provided in each seal ring groove 35 to impart a fluid-tight seal between the stator 26 and the interior surface of the stator cavity 19.

The stator 26 of each fluid pressure intensifying assembly 20 may be adapted for rotation inside the stator cavity 19 of the corresponding high pressure fluid conduit 16. As illustrated in FIG. 2, stator teeth 27 may be provided on the exterior surface of the stator body 26*a*. As illustrated in FIG. 10, the stator teeth 27 of the stator 26 may mesh with the ring gear teeth 22 of the ring gear 21. Accordingly, as the device shaft 10 rotates in the device housing 2 in the clockwise or counterclockwise direction indicated by the arrow 74 in FIG. 10, the ring gear teeth 22 of the ring gear 21 progressively mesh with the stator teeth 27 of the stator 26. Therefore, the device shaft 10 transmits rotation to the stator 26 through the ring gear teeth 22 and the stator teeth 27, respectively, such that the stator 26 rotates in the opposite, counterclockwise or clockwise direction indicated by the arrow 75 in stator cavity 19 of the high pressure fluid conduit 16. Each stator 26 repeatedly rotates in the stator cavity 19 of the corresponding high pressure fluid conduit 16 as the stator 26 completes a full revolution around the ring gear 21. The number of rotations completed by each stator 26 as the device shaft 10 completes one full rotation inside the device housing 2 (and as the stator 26 completes one revolution around the ring gear 21) depends on the diameter of the stator 26 relative to the diameter of the device shaft 10.

Figure 1:
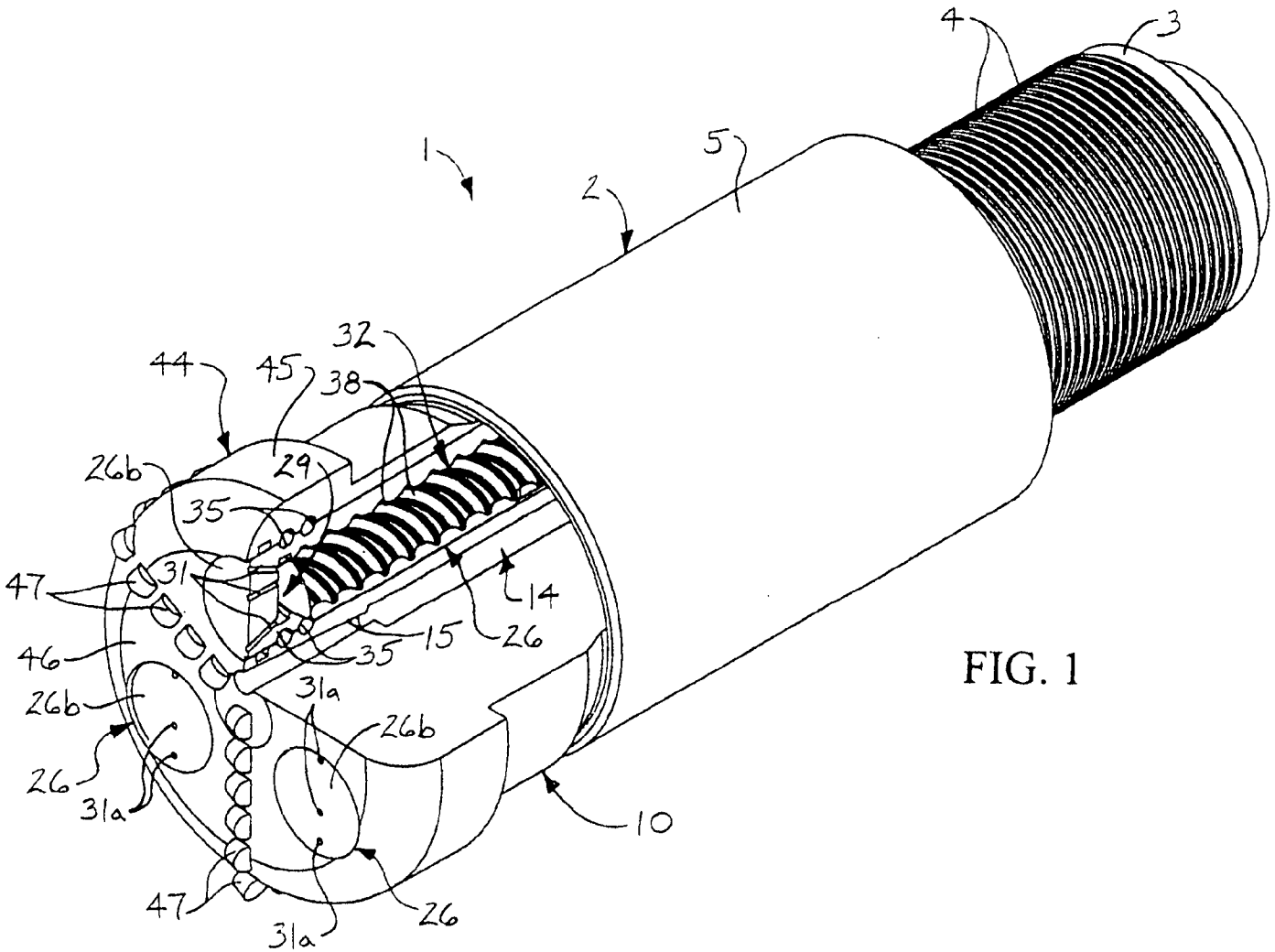
FIG. 1 is a perspective view, partially in section, of an illustrative embodiment of the drilling pressure intensifying device, with a device shaft inserted in a device housing of the device.

As illustrated in FIGS. 6 and 8, each stator 26 may have a stator interior 29. As illustrated in FIG. 6, the stator interior 29 of the stator 26 may be disposed in fluid communication with the rotor cavity 17 of the high-pressure fluid conduit 16 and with the low pressure fluid conduit 14 through the fluid diversion passage 18. As illustrated in FIGS. 6 and 7, stator threads 30 and stator grooves 30*a* may be formed in the interior surface of the stator 26 in the stator interior 29. The stator threads 30 and the stator grooves 30*a* may have a winding, clockwise or counterclockwise spiral or corkscrew configuration throughout at least a portion of the length of the stator 26. As illustrated in FIGS. 6 and 7, at least one high pressure fluid outlet passage 31 may be disposed in fluid communication with the stator interior 29 of the stator 26. As illustrated in FIGS. 1, 2 and 9, each high pressure fluid outlet passage 31 may communicate with a high pressure discharge opening 31*a* which opens to the fluid discharge end 26*b* of the stator 26. As illustrated in FIG. 10, at least one stator lobe 24 may be provided in the interior surface of the stator 26 for purposes which will be hereinafter described. In the embodiment illustrated in FIG. 10, a pair of stator lobes 24 is provided in the interior surface of the stator 26 in opposed relationship with respect to each other.

As illustrated in FIGS. 7 and 8, in some embodiments an annular ball bearing space 50 may be provided between the stator 26 and the interior surface of the stator cavity 19 (FIG. 17) of the high pressure fluid conduit 16. Multiple ball bearings 51 may be provided in the ball bearing space 50. The ball bearings 51 may reduce friction between the stator 26 and the device shaft 10 and between the stator 26 and the drill bit 44 as the stator 26 rotates in the stator cavity 19. A ball bearing passage 52 may establish communication between the exterior surface of the device shaft 10 and each ball bearing space 50 to facilitate insertion of the ball bearings 51 into and removal of the ball bearings 51 from the ball bearing space 50 as deemed necessary for replacement and/or maintenance purposes. A removable set screw 53 may be provided in each set screw cavity 52 to close the set screw cavity 52.

A rotor 32 is provided in the stator interior 29 of the stator 26. As illustrated in FIG. 3, the rotor 32 may include a rotor shaft 36 having a rotor base 37. Rotor threads 38 and rotor grooves 39 may be provided in the rotor shaft 36 adjacent to the rotor base 37. The rotor threads 38 and the rotor grooves 39 on the rotor shaft 36 may have a winding, clockwise or counterclockwise spiral or corkscrew configuration the pitch and handedness of which match the pitch and handedness of the stator grooves 30*a* and the stator threads 30 (FIG. 6), respectively, in the stator interior 29 of the stator 26. The rotor shaft 36 may have at least one rotor lobe 40 when viewed in cross-section, as illustrated in FIG. 10. In the embodiment illustrated in FIG. 10, the rotor 32 has one lobe 40. In some embodiments, the rotor shaft 36 may have two, three or more rotor lobes 40. In FIGS. 5 and 6, the rotor 32 is omitted from the stator interior 29 of the stator 26.

As illustrated in FIG. 5, the device shaft 10 may be adapted for rotation inside the device housing 2 by operation of a positive displacement motor (commonly known as a "mud motor") (not illustrated) which is coupled to the drill string 60. The positive displacement motor may be any type of pump or mud motor which is used to drive drill bits in well bore drilling operations. Mud motors which are suitable for the purpose include ROPER® positive displacement motors and Robbins & Myers progressing cavity motors, for example and without limitation.

As further illustrated in FIG. 5, the drill string 60 may include a top sub 61 which is coupled to a tubing string (not illustrated) typically in the conventional manner. A drill string stator 62 may be attached to the top sub 61 through a threaded or other connection 70. Drill string tubing 64 may be attached to the drill string stator 62 through a threaded or other connection 71. The housing collar 3 of the device housing 2 may be threadably connected to the drill string tubing 64 through the housing collar threads 4 provided on the housing collar 3.

A drill string rotor 63 may be rotatable inside the drill string stator 62 of the drill string 60. A constant velocity (CV) joint 68 may be drivingly engaged by the drill string rotor 63. A radial coupling 67 may be drivingly engaged by the CV joint 68. The fluid inlet end 11 of the device shaft 10 may be drivingly engaged by the radial coupling 67 through a threaded or other connection 65. Thrust bearings 66 may be provided between the drill string tubing 64 and the device shaft 10. A fluid conduit 67*a* may extend through the radial coupling 67 and establish fluid communication between the drill string rotor 63 and the low pressure fluid conduit 14 of the device shaft 10.

As the mud motor (not illustrated) pumps drilling fluid 56 (commonly known as "drilling mud") from the tubing string (not illustrated) to which the drill string 60 is attached and through the drill string rotor 63 of the drill string 60, the flowing drilling fluid 56 rotates the drill string rotor 63 in the stationary drill string stator 62. The CV joint 68 and the radial coupling 67 transmit torque from the rotating drill string rotor 63 to the device shaft 10 of the device 1. The CV joint 68 may remove eccentricity and nutation of the drill string stator 62 and the drill string rotor 63. The drilling fluid 56 flows from the drill string rotor 63, through the fluid passages 69 around the CV joint 68 and the fluid conduit 67*a* in the radial coupling 67 and into the low pressure fluid conduit 14 of the device shaft 10, respectively. The drilling fluid 56 flows through the low pressure fluid conduit 14 as a low pressure stream 57 of drilling fluid 56. In some embodiments, at least a portion of the low pressure drilling fluid stream 57 may flow from the low pressure fluid conduit 14 through at least one of the low pressure fluid outlet passages 15 for discharge from the drill bit face 46 of the drill bit 44 through at least one low pressure discharge opening 15*a* (FIG. 9). In some applications, the low pressure drilling fluid steam 57 may have a fluid pressure from about 300 psi to about 3000 psi.

As the device shaft 10 rotates in the device housing 2 of the device 1, as indicated by the arrow 74 in FIG. 10, the stator 26 of each fluid pressure intensifying assembly 20 revolves around the low pressure fluid conduit 14 in the same direction. Simultaneously, the stator teeth 27 on the stator 26 mesh with the ring gear teeth 22 on the stationary ring gear 21, causing the stator 26 to rotate in the direction indicated by the arrow 75 in FIG. 10. In turn, the stator 26 transmits rotation to the rotor shaft 36 of the rotor 32 as the stator lobes 24 inside the stator 26 alternately engage the rotor lobes 40 on the rotor 32. Therefore, the rotor 32 rotates in the stator interior 29 of the stator 26 in the same direction as the stator 26.

In the embodiment illustrated in FIG. 10, the presence of the two stator lobes 24 in the stator 26 in combination with the single rotor lobe 40 on the rotor 32 causes the rotor 32 to complete two rotations each time the stator 26 completes one rotation. Therefore, the stator 26 and the rotor 32 stay in time but the rotor 32 rotates faster than the stator 26 depending on the lobe configuration of the rotor 32 and the stator 26. Thus, the ratio of the number of rotor lobes 40 to the number of stator lobes 24 may be selected to vary the rotational speed of the rotor 32 for purposes which will be hereinafter described. Exemplary rotor lobe: stator lobe ratios are 1:2; 2:3; 3:4; 4:5; and 5:6. As illustrated in FIG. 7, as the rotor 32 rotates in the stator cavity 19 of the stator 26, on one side of the stator 26 the rotor threads 38 and rotor grooves 39 on the rotor 32 mesh with the stator grooves 30*a* and the stator threads 30, respectively, on the stator 26. On the other side of the stator 26, the rotor threads 38 and rotor grooves 39 wind from the fluid diversion passage 18 toward the stator interior 29 and past the stator threads 30 and stator grooves 30*a*.

Figure 11:
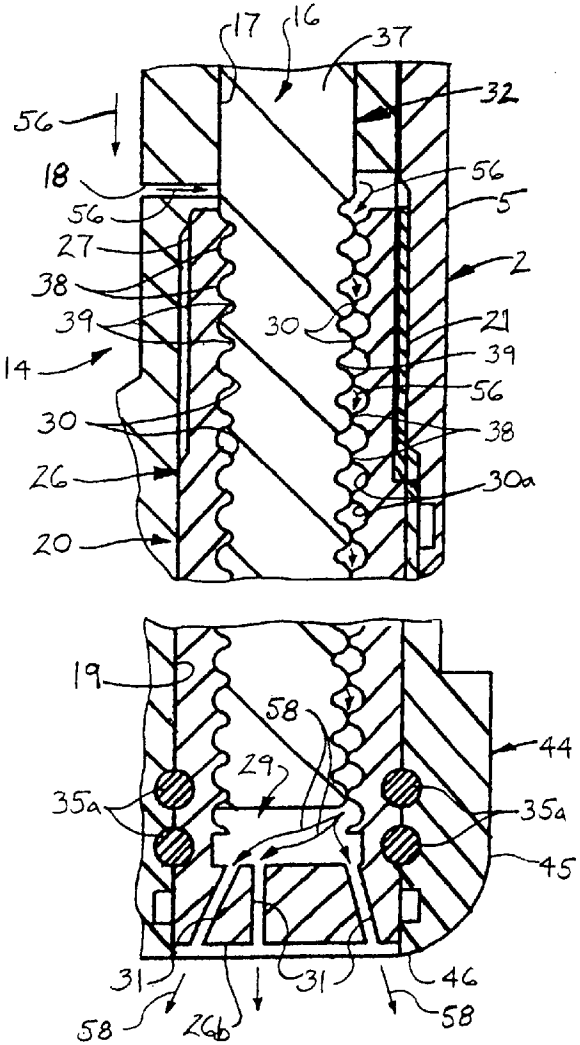
FIG. 11 is an enlarged sectional view of a fluid pressure intensifying assembly of an illustrative embodiment of the drilling pressure intensifying device, more particularly illustrating exemplary flow of drilling fluid through the assembly in implementation of the device.

As illustrated in FIG. 5, at least a portion of the drilling fluid 56 flows from the low pressure fluid conduit 14 through at least one fluid diversion passage 18 and into at least one high pressure fluid conduit 16. As illustrated in FIG. 11, in the stator cavity 19 of the high pressure fluid conduit 16, on one side of the stator 26 the drilling fluid 56 flows between the rotor threads 38 and rotor grooves 39 of the rotor 32 and the stator threads 30 and stator grooves 30*a* of the stator 26 as the rotor threads 38 and rotor grooves 39 wind from the fluid diversion passage 18 toward the stator interior 29. On the other side of the stator 26, the rotor threads 38 and rotor grooves 39 on the rotor 32 mesh with the stator grooves 30*a* and the stator threads 30 on the stator 26. Consequently, the drilling fluid 56 is compressed between the winding rotor threads 38 of the rotor 32 and the stator threads 30 of the stator 26 and the rotor threads 38 on the rotor 32 force the drilling fluid 56 from the fluid diversion passage 18 toward the high pressure fluid outlet passages 31 in the stator 26. Therefore, the fluid pressure of the drilling fluid 56 progressively increases as it flows from the fluid diversion passage 18 toward the high pressure fluid outlet passages 31 in the stator 26. The drilling fluid 56 flows from the high pressure fluid conduit 16 through at least one high pressure fluid outlet passage 31 and is discharged as a high pressure stream 58 of drilling fluid 56 through at least one high pressure discharge opening 31*a* (FIG. 9) provided in the fluid discharge end 26*b* of the stator 26. In some applications, the high pressure stream or streams 58 of the drilling fluid 56 may have a fluid pressure of greater than about 3000 psi.

It will be appreciated by those skilled in the art that the volume and pressure of the high pressure stream or streams 58 of the drilling fluid 56 as it is discharged from the high pressure discharge opening or openings 31*a* may be controlled by the rpm of the rotor shaft 36 as well as the number of rotor lobes 40 on the rotor shaft 36 of the rotor 32 and the lead of each rotor lobe 40. Longer leads for the rotor lobes 40 and a greater number of rotor lobes 40 on the rotor shaft 36 may result in correspondingly greater volume with less pressure of the high pressure streams 58 of the drilling fluid 56. In the embodiment illustrated in FIG. 10, one rotation of each stator 26 causes two rotations of the rotor 32. One rotation of each rotor lobe 40 represents one stage and each stage corresponds to a pressure increase of the drilling fluid 56.

In an exemplary application, the device 1 is attached to a drill string 60 (FIG. 5) which is provided on a tubing string (not illustrated) to augment the drilling efficacy or speed of the drill bit 44 on the device 1 in the drilling of a subterranean hydrocarbon well bore (not illustrated). Accordingly, a mud motor (not illustrated) is connected to the tubing string typically in the conventional manner. Drilling fluid 56 is pumped from the mud motor and through the tubing string and the drill string 60 to rotate the drill bit 44 and drill a well bore (not illustrated) through a subterranean hydrocarbon formation. The low pressure drilling fluid stream 57 which is discharged through the low pressure discharge openings 15*a* (FIG. 9) of the drill bit 44 is ejected against the formation and dislodges or loosens the formation, complementing the cutting action of the drill bit 44 and increasing the speed at which the drill bit 44 drills through the formation. The high pressure drilling fluid stream or streams 58 discharged through the high pressure discharge openings 31*a* (FIG. 9) in the fluid discharge end 26*b* of the stator 26 are also ejected against the formation, further dislodging or loosening the formation and enhancing the drill speed and cutting action of the drill bit 44 through the formation. In some applications, the drilling fluid 56 which is ejected from the low pressure discharge openings 15*a* and the high pressure discharge openings 31*a* may be pumped back to the well surface (not illustrated), filtered and again pumped through the tubing string, the drill tubing 60 and the device 1 in a continuous loop, as is known by those skilled in the art.

While the preferred embodiments of the disclosure have been described above, it will be recognized and understood that various modifications can be made in the disclosure and the appended claims are intended to cover all such modifications which may fall within the spirit and scope of the disclosure.

What is claimed is:

1. A drilling pressure intensifying device, comprising:
a device housing;
a device shaft mounted for rotation in said device housing;
a ring gear having ring gear teeth carried by said device shaft;
at least one low pressure fluid conduit in said device shaft;
at least one high pressure fluid conduit in said device shaft and disposed in fluid communication with said at least one low pressure fluid conduit; and
a fluid pressure intensifying assembly including a stator having a stator interior in said at least one high pressure fluid conduit and stator teeth provided on said stator and meshing with said ring gear teeth of said ring gear and drivingly engaged for rotation by said device shaft through said ring gear and a rotor provided in said stator interior of said stator and drivingly engaged for rotation by said stator.

2. The device of claim 1 further comprising spiral stator threads and stator grooves provided on said stator in said stator interior and spiral rotor threads and rotor grooves provided on said rotor and partially meshing with said stator grooves and said stator threads, respectively, of said stator.

3. The device of claim 1 further comprising at least one rotor lobe provided on said rotor and at least one stator lobe provided in said stator and engaging said at least one rotor lobe.

4. The device of claim 3 wherein said at least one stator lobe comprises at least two stator lobes.

5. The device of claim 1 further comprising a plurality of high pressure fluid outlet passages communicating with said stator interior of said stator.

6. The device of claim 1 wherein said at least one low pressure fluid conduit is centrally disposed in said device shaft and said at least one high pressure fluid conduit comprises a plurality of high pressure fluid conduits eccentrically located with respect to a central rotational axis of said device shaft around said at least one low pressure fluid conduit.

7. A drilling pressure intensifying device, comprising:
a device housing;
a device shaft mounted for rotation in said device housing;
a ring gear having ring gear teeth carried by said device shaft;
a drill bit terminating said device shaft;
at least one low pressure fluid conduit in said device shaft and opening through said drill bit;
at least one high pressure fluid conduit in said device shaft and disposed in fluid communication with said at least one low pressure fluid conduit; and
a fluid pressure intensifying assembly in said at least one high pressure fluid conduit and including:
a stator drivingly engaged for rotation by said device shaft and having a stator interior opening through said drill bit, spiral stator threads and spiral stator grooves in said stator interior and at least one stator lobe in said stator interior;
stator teeth provided on said stator and meshing with said ring gear teeth of said ring gear; and
a rotor having a rotor shaft base rotatable in said stator interior of said stator, spiral rotor threads and spiral rotor grooves on said rotor shaft base and partially meshing with said stator grooves and said stator threads, respectively, of said stator and at least one rotor lobe shaped in said rotor shaft base and engaged by said at least one stator lobe.

8. The device of claim 7 further comprising a plurality of high pressure fluid outlet passages communicating with said stator interior of said stator and discharging through said drill bit.

9. The device of claim 7 further comprising a plurality of low pressure fluid outlet passages communicating with said at least one low pressure fluid conduit and discharging through said drill bit.

10. The device of claim 7 wherein said at least one low pressure fluid conduit is centrally disposed in said device shaft and said at least one high pressure fluid conduit comprises a plurality of high pressure fluid conduits eccentrically located with respect to a central rotational axis of said device shaft around said at least one low pressure fluid conduit.

11. The device of claim 7 further comprising a plurality of ball bearings between said stator and said device shaft.

12. A drilling pressure intensifying device, comprising:
a device housing;
a device shaft mounted for rotation in said device housing and having a fluid inlet end and a fluid outlet end opposite said fluid inlet end;
a drill bit terminating said device shaft at said fluid outlet end;
a low pressure fluid conduit centrally disposed in said device shaft and extending generally from said fluid inlet end to said fluid outlet end;
a plurality of low pressure fluid outlet passages communicating with said low pressure fluid conduit and opening through said drill bit;
a plurality of high pressure fluid conduits eccentrically located with respect to a central rotational axis of said device shaft and spaced around said low pressure fluid conduit;
a plurality of fluid diversion passages establishing fluid communication between said low pressure fluid conduit and said plurality of high pressure fluid conduits, respectively;
a ring gear having ring gear teeth between said device shaft and said device housing;
a fluid pressure intensifying assembly in each of said high pressure fluid conduits and including:
a stator mounted for rotation in said high pressure fluid conduit and having a stator interior, spiral stator threads and spiral stator grooves in said stator and facing said stator interior, at least one stator lobe on said stator in said stator interior and stator teeth provided on said stator and meshing with said ring gear teeth of said ring gear; and
a rotor rotatable in said stator interior of said stator, spiral rotor threads and spiral rotor grooves on said rotor and partially meshing with said stator grooves and said stator threads, respectively, of said stator and at least one rotor lobe shaped in said rotor and engaged by said at least one stator lobe of said stator; and a plurality of high pressure fluid outlet passages communicating with said stator interior of said stator and opening and discharging through said drill bit.

13. The drilling pressure intensifying device of claim 12 further comprising a ball bearing space between said device shaft and each of said plurality of rotors and a plurality of ball bearings in said ball bearing space.

14. The drilling pressure intensifying device of claim 13 further comprising a ball bearing passage in said device shaft and communicating with said ball bearing space and a set screw in said ball bearing passage.

15. The drilling pressure intensifying device of claim 12 wherein said at least one stator lobe comprises at least two stator lobes.

16. The drilling pressure intensifying device of claim 12 wherein said plurality of high pressure fluid conduits comprises three high pressure fluid conduits spaced equally around said low pressure fluid conduit.

17. A drilling pressure intensifying device, comprising:

a device housing;

a device shaft mounted for rotation in said device housing;

a ring gear having ring gear teeth carried by said device shaft;

at least one fluid conduit in said device shaft; and a fluid pressure intensifying assembly in said at least one fluid conduit and including:

a stator drivingly engaged for rotation by said device shaft and having a stator interior, spiral stator threads and spiral stator grooves in said stator interior and at least one stator lobe;

stator teeth provided on said stator and meshing with said ring gear teeth of said ring gear;

a rotor drivingly engaged for rotation by said stator in said stator interior and having spiral rotor threads and spiral rotor grooves partially meshing with said stator grooves and said stator threads, respectively, of said stator and at least one rotor lobe engaged by said at least one stator lobe of said stator.

18. The device of claim 17 further comprising a plurality of high pressure fluid outlet passages disposed in fluid communication with said stator interior of said stator.

19. The device of claim 18 further comprising a drill bit terminating said device shaft and wherein said plurality of high pressure fluid outlet passages discharge through said drill bit.

20. The device of claim 17 wherein said at least one stator lobe comprises at least two stator lobes.

* * * * *